US005207840A

United States Patent [19]

Riesop et al.

[11] Patent Number: 5,207,840

[45] Date of Patent: May 4, 1993

[54] PROCESS FOR PREPARING ZINC PHOSPHATE COATINGS CONTAINING MANGANESE AND MAGNESIUM

[75] Inventors: Joerg Riesop, Niederzier; Karl-Heinz Gottwald, Erftstadt; Wolf-Achim Roland, Solingen, all of Fed. Rep. of Germany

[73] Assignee: Henkel Kommanditgesellschaft auf Aktien, Duesseldorf-Holthausen, Fed. Rep. of Germany

[21] Appl. No.: 776,319

[22] PCT Filed: Jun. 12, 1990

[86] PCT No.: PCT/EP90/00919

§ 371 Date: Dec. 16, 1991

§ 102(e) Date: Dec. 16, 1991

[87] PCT Pub. No.: WO90/15889

PCT Pub. Date: Dec. 27, 1990

[30] Foreign Application Priority Data

Jun. 21, 1989 [DE] Fed. Rep. of Germany ..... 3920296

[51] Int. Cl.[5] ..... C23C 22/36; C23C 22/18

[52] U.S. Cl. ..... 148/260; 148/262

[58] Field of Search ..... 148/262, 260

[56] References Cited

U.S. PATENT DOCUMENTS

| | | | |
|---|---|---|---|
| 3,676,224 | 7/1972 | Snee | 148/262 |
| 3,726,720 | 4/1973 | Guhde | 148/262 |
| 4,717,431 | 1/1988 | Knaster | 148/262 |
| 4,849,031 | 7/1989 | Hauffe | 148/262 |
| 4,897,128 | 1/1990 | Dosch | 148/262 |

*Primary Examiner*—Sam Silverberg
*Attorney, Agent, or Firm*—Ernest G. Szoke; Wayne C. Jaeschke; Norvell E. Wisdom, Jr.

[57] ABSTRACT

Magnesium on steel, zinc, aluminum and/or the alloys thereof by spraying, spray-immersion and/or immersion with an aqueous solution.

20 Claims, No Drawings

PROCESS FOR PREPARING ZINC PHOSPHATE COATINGS CONTAINING MANGANESE AND MAGNESIUM

BACKGROUND OF THE INVENTION

1. Field of Invention

The present invention relates to a process for phosphating metal surfaces, and especially to a process for preparing zinc phosphate coatings containing manganese and magnesium on steel, zinc, aluminum and/or the alloys thereof. These zinc phosphate layers containing manganese and magnesium are applied by spraying, spray-immersion and immersion with aqueous solutions.

2. Statement of Related Art

Processes for phosphating surfaces of iron, steel, zinc and the alloys thereof as well as of aluminum since long have been state of the art (Ullmanns Encyklopädie der technischen Chemie, 4th Edition, Volume 15, pages 686 and 687). Phosphating said surfaces serves to increase the adhesion strength of paint layers and to improve the protection from corrosion.

Of the greatest importance as phosphating processes are acidic solutions of zinc and alkali phosphates. For example, zinc phosphating baths may contain monozinc phosphate, free phosphoric acid, zinc nitrate and oxidizing agents as the main components. The pH value of such compositions is conventionally in the range between 2.8 and 3.4. The course of the process essentially consists of two reactions: the mordanting reaction and the formation of a zinc phosphate layer on the surface to be phosphated.

From W. A. Roland and K. -H. Gottwald, "Metalloberfläche", 42nd Year 1988/6 there have been known manganese-modified zinc phosphate coatings as adhesion primer for modern paint coatings. Here it is set forth that the use of manganese ions besides zinc and nickel ions in low-zinc phosphating processes, especially upon use of surface-modified thin sheets, demonstrably improves the anticorrosive property. The incorporation of manganese in the zinc phosphate coatings results in smaller and more compact crystals having an increased alkali resistance. At the same time the working range of phosphating baths is extended; aluminum also can be phosphated in a composite with steel and steel which has been galvanized electrolytically or by melt immersion to form a layer, with the quality standard reached in general being ensured.

From EP-A-0 261 704 there has been known a process for producing phosphate coatings on surfaces which are formed of aluminum or alloys thereof as well as at least one of the materials steel or galvanized steel; therefor, in order to achieve the formation of uniform phosphate layers with a high degree of covering power, spraying or spray-immersion is employed using a phosphating solution which may contain, in addition to zinc, phosphate and fluoride, also further cations from the group of nickel, manganese, magnesium and calcium.

From WO 85/03089 there has been known a high-nickel zinc phosphating process. Herein, extremely high nickel concentrations are employed for phosphating. It is generally referred to that part of the nickel may basically be replaced by a series of monovalent or divalent cations. They have been selected, for example, from cobalt, manganese and magnesium. It is further set forth that the nickel content of the solution to be employed must be at least 1.0 g/l. The ratio to be employed between low zinc and high nickel contents is an essential constituent of the technical teaching.

DESCRIPTION OF THE INVENTION

Summary of the Invention

It was the object of the present invention to provide a phosphating process which is nickel-free or has an extremely low nickel content in comparison to prior art, since nickel represents an extraordinarily expensive bath component and, besides, is ecologically suspicious. Since a discharge of waste fluids containing nickel is subject to costs, the object was further to attain the effect caused by nickel of a layer refinement by means of ecologically less suspicious ions.

One advantage of the present invention consists of that extraordinarily low area-related masses of the phosphate layers could be obtained without loss in the anticorrrosive property. This is particularly true for steel surfaces.

By way of a separate activation and the addition of magnesium to the bath compositions according to the invention, very small crystals could be obtained, having an edge length of about 0.5 to 1.5 μm in phosphating by the immersion procedure and of about 1 to 2 μm by the spray procedure. With the aid of the present invention, a very low hopeite proportion could be accomplished in the phosphate layers, especially on steel. The reason is to be seen particularly in the incorporation of an additional cation and in that according to the invention a low zinc content is employed.

Good corrosion test values could be obtained without a use of nickel as well as upon substitution of part of the nickel contents by magnesium with respect to the sublayer permeation at the cut as well as to the result of paint adhesion on steel. The substitution by magnesium of nickel provided very good corrosion test values.

In the phosphating of surfaces of steel or zinc, the use of fluoride ions is not indispensably necessary. In the case of phosphating surfaces of aluminum or its alloys, the use of fluoride ions results in a uniform degree of covering power of the phosphate layers on the aluminum. As the examples for surfaces of aluminum and its alloys there may be mentioned those of high-grade aluminum, AlMg and AlMgSi wrought materials. An extensive presentation of aluminum materials is found, for example, in the "Aluminiumtaschenbuch",14th Edition, Aluminium-Verlag, Düsseldorf, 1988.

The term "steel" is understood to denote a nonalloyed or low-alloyed steel as used, e.g., in the form of sheets for the manufacture of bodies. The term "galvanized steel" comprises, e.g., galvanizations by the electrolytic route as well as by the melt immersion route and refers to zinc and zinc alloys, e.g. Z, ZE, ZNE, ZF, ZA, AZ.

Phosphating within the meaning of the present invention is effected by spraying, spray-immersion and immersion. The metal surfaces to be phosphated must be free from interfering coatings and stains of oils, lubricants, oxides and the like. Prior to phosphating the surfaces are cleaned in a suitable manner and, optionally, activated with per se known activating agents, e.g. aqueous suspensions containing titanium salt(s). Conventionally, the activating agent may be introduced in the cleaner bath or as a separate process etc.

As accelerators there may be used the substances as generally conventional in the phosphating technology.

It is of particular advantage to contact the surface with an aqueous phosphating solution which contains, as accelerators, chlorate, nitrate, nitrite, peroxide and/or organic oxidizing agents, especially organic nitro compounds.

Furthermore, the phosphating solutions may contain additives known in the phosphating technology for modifying the operational procedure and the layer properties. As examples there may be mentioned: Surfactants, polyhydroxycarboxylic acids, polyphosphates, ammonium, alkali, copper, cobalt ions and indifferent anions such as chloride and/or sulfate.

The object mentioned above is attained by means of a process for preparing zinc phosphate coatings containing manganese and magnesium on steel, zinc, aluminum and/or the alloys thereof by spraying, spray-immersion and/or immersion with an aqueous solution containing

| |
|---|
| 0.2 to 1.0 g/l of zinc(II) ions, |
| 0.2 to 2.0 g/l of manganese(II) ions, |
| 0.5 to 2.0 g/l of magnesium(II) ions, |
| 10.0 to 20.0 g/l of phosphate ions, |
| 0.0 to 1.0 g/l of fluoride ions, |
| 0.2 to 10.0 g/l of nitrate ions and, |

as accelerator(s),

| |
|---|
| 0.02 to 0.2 g/l of nitrite ions and/or |
| 0.4 to 1 g/l of chlorate ions and/or |
| 0.2 to 1.0 g/l of an organic oxidant, |

the aqueous solution having a content of free acid of from 0.6 to 1.8 points and a total acid content of from 15 to 30 points, and $Na^+$ being present in the amount necessary for adjusting the free acid.

The presence of the nitrate ions is caused by the use of metal nitrates, for example $Zn(NO_3)_2$, for preparing the concentrates employed and, thus, a consequence of the selection of the (inexpensive) raw materials.

Description of Preferred Embodiments

Thus, according to the present invention, in a first embodiment there is described a low-zinc process wherein magnesium has been substituted for nickel. Thus, the present invention relates to a zinc phosphating process which especially can be employed in the low-zinc range. By means of this process there are employed phosphate layers which contain, as cations, also manganese in addition to zinc and magnesium. Under certain plant conditions the addition of nickel ions may be beneficial. Thus, in surfaces containing zinc (Z, ZE) and with the alloys ZNE, ZF, ZA and AZ, improved phosphating results are obtained due to the presence of nickel, whereas any positive effect has not been observed with steel surfaces.

According to a preferred embodiment of the present invention, the process for preparing zinc phosphate coatings on steel, zinc, aluminum and/or the alloys thereof by spraying, spray-immersion and/or immersion with an aqueous solution is modified in that an aqueous solution containing

| |
|---|
| 0.4 to 0.6 g/l of zinc(II) ions, |
| 0.9 to 1.1 g/l of manganese(II) ions, |
| 1.4 to 1.6 g/l of magnesium(II) ions, |
| 12.0 to 16.0 g/l of phosphate ions, |

-continued

| |
|---|
| 1.0 to 5.0 g/l of nitrate ions and |
| 0.4 to 0.6 g/l of fluoride ions |

are employed. The content of free acid and the total acid content conform to that mentioned above, and so does the amount of sodium ions.

In a further preferred embodiment of the present invention the solutions to be used may contain minor amounts nickel(II) ions. Preferred under this aspect are, thus, solutions containing from 0.2 to 0.8 g/l, and more particularly from 0.25 g/l to 0.5 g/l, of nickel(II) ions.

According to a preferred embodiment of the present invention, 3-nitrobenzenesulfonic acid is employed as an organic oxidant.

As a preferred organic oxidant there is employed the sodium salt of 3-nitrobenzenesulfonic acid.

In a preferred embodiment of the present invention, phosphating is carried out at a temperature within the range of from 40° C. to 70° C. In a further embodiment of the present invention, the steel surfaces are preferably phosphated to form layers in the course of from 1 to 5 minutes.

The surface layers produced by means of the process according to the invention are well usable in all fields where phosphate coatings are used. A case of particular advantageous application is the preparation of the metal surfaces for painting, and especially for electro-dip-coating.

EXAMPLES

In the course of the conventional process sequence comprising the steps of

1. Cleaning and degreasing:

Use of surfactant-containing alkaline cleaning agents by spraying and/or immersion (=RIDOLINE® C 1250) at from 50° C. to 60° C. and treatment periods of from 1 to 5 minutes.

2. Rinsing

3. Activating:

Use of agents containing titanium salt (=FIXODINE® C 9112) by spraying or immersion at from 20° C. to 40° C. and treatment periods of from 30 to 180 seconds in separate application. The activation may be omitted, if said activating agent is added to the cleaning step.

4. Phosphating:

Composition see Table 1.

5. Rinsing:

6. After-passivation:

Use of chromium-containing or chromium-free after-passivating agents (=DEOXYLYTE® 41 or DEOXYLYTE® 80) by spraying or immersion at from 20° C. to 50° C. and treatment periods of from 30 to 180 seconds.

7. Rinsing with fully desalted water the surface treatment of cold-rolled steel St.1405, electrolytically galvanized steel (Zn layer thickness 7.5 μm on either side) and steel galvanized by melt immersion (Zn layer thickness 10 μm on either side) was carried out

TABLE 1

| Phosphating | | | |
|---|---|---|---|
| | Type of Application | | |
| Bath parameters | Spraying ($A_1$) | Spraying ($A_2$) | Spray-Immersion(C) |
| FS[1)] (Points) | 0.8 | 0.8 | 0.9 |

TABLE 1-continued

| | Phosphating | | |
|---|---|---|---|
| GS[2] (Points) | 21 | 21 | 23 |
| $Zn^{2+}$ $g.l^{-1}$ | 0.5 | 0.5 | 0.5 |
| $Mn^{2+}$ $g.l^{-1}$ | 1.0 | 1.0 | 1.0 |
| $Ni^{2+}$ $g.l^{-1}$ | 0.0 | 0.8 | 0.8 |
| $Mg^{2+}$ $g.l^{-1}$ | 1.5 | 1.5 | 1.5 |
| $PO_4^{3-}$ $g.l^{-1}$ | 13.0 | 13.0 | 16.0 |
| $NO_2^-$ $g.l^{-1}$ | 0.1 | 0.1 | 0.1 |
| $NO_3^-$ $g.l^{-1}$ | 1.6 | 2.0 | 1.2 |
| Temp. °C. | 55 | 55 | 54 |
| Time s | 150 | 150 | 30 S/180 T |

S: Spraying; T: Immersion
[1]FS = Free Acid
[2]GS = Total Acid

| | Type of Application | |
|---|---|---|
| Bath parameters | Immersion($B_1$) | Immersion($B_2$) |
| FS (Points) | 1.0 | 1.0 |
| GS (Points) | 20 | 20 |
| $Zn^{2+}$ $g.l^{-1}$ | 0.5 | 0.5 |
| $Mn^{2+}$ $g.l^{-1}$ | 1.0 | 1.0 |
| $Ni^{2+}$ $g.l^{-1}$ | 0.0 | 0.8 |
| $Mg^{2+}$ $g.l^{-1}$ | 1.4 | 1.4 |
| $PO_4^{3-}$ $g.l^{-1}$ | 12.0 | 12.0 |
| $NO_2^-$ $g.l^{-1}$ | 0.1 | 0.1 |
| $NO_3^-$ $g.l^{-1}$ | 3.0 | 3.0 |
| Temp. °C. | 55 | 55 |
| Time s | 180 | 180 |

By means of the variants mentioned above, area-related masses of the phosphate layer were produced on steel of from 0.6 to 2.5 $g.m^{-2}$ and on galvanized steel of from 1.8 to 4.0 $g.m^{-2}$.

Typical layer analysis (quantitative analysis by atomic absorption spectroscopy, AAS) of the process on

| | Type of Application | | | |
|---|---|---|---|---|
| | Immersion | | Spraying | |
| Element | $B_2$ % | $B_1$ (nickel-free) % | $A_2$ % | $A_1$ (nickel-free) % |
| a) Steel | | | | |
| Iron | 6.0 | 5.4 | 2.3 | 1.9 |
| Manganese | 4.3 | 4.9 | 5.9 | 6.1 |
| Nickel | 0.8 | 0.0 | 0.8 | 0.0 |
| Magnesium | 0.7 | 0.9 | 1.1 | 1.0 |
| Zinc | 24.6 | 29.5 | 30.7 | 31.9 |
| Average area-related mass according to DIN 50942: | 1.7 $g.m^{-2}$ | | 1.0 $g.m^{-2}$ | |
| b) Electrolytically galvanized steel | | | | |
| Manganese | 4.6 | 5.7 | 5.3 | 5.7 |
| Nickel | 0.8 | 0.0 | 0.7 | 0.0 |
| Magnesium | 1.2 | 1.2 | 1.2 | 1.4 |
| Zinc | 34.4 | 34.1 | 33.8 | 33.8 |
| Average area-related mass according to DIN 50942: | 2.2 $g.m^{-2}$ | | 2.5 $g.m^{-2}$ | |

With the sheets obtained by means of the application types ($A_1$),($B_2$) and (C), corrosion tests in changing climate were carried out according to the VW Standard P 1210 over a testing period of 60 days and according to the VDA Standard over 5/10 cycles. (As the paint coating there was used the Standard KET primer FT 85 7042, producer BASF Farben und Lacke AG).

1. VW Changing Climate Test P 1210
Processes $A_1$ and Immersion $B_1$
{Spraying ($A_1$) and Immersion ($B_1$)}

| | $A_1$ 60 Days | $B_1$ 60 Days | | |
|---|---|---|---|---|
| | CRS[1] | CRS[1] | Z[2] | ZE[3] |
| Area according to DIN 53209[4] | m0/g0 | m0/g0 | m0/g0 | m0/g0 |
| Cut according to DIN 53167 in mm | 0.8 | 0.5 | 0.1 | 0.3 |
| Rockfall according to VW Standard | K6 | K5 | K3 | K3 |

[1]CRS = Cold-rolled steel St 1405
[2]Z = Melt immersion-galvanized steel
[3]ZE = Electrolytically galvanized steel 2. VDA Changing Climate Test 621-415

| | 5 Cycles (35 Days) | | | 10 Cycles (70 Days) | | |
|---|---|---|---|---|---|---|
| | CRS[1] | Z[2] | ZE[3] | CRS | Z | ZE |
| Process $B_2$ (Immersion) | | | | | | |
| Area according to DIN 53209 | m0/g0 | m0/g0 | m0/g0 | m0/g0 | m0/g0 | m0/g0 |
| Cut according to DIN 53167 in mm | 0.2 | 1.2 | 1.4 | 0.3 | 1.7 | 1.9 |
| Rockfall according to VW Standard | K2 | K1 | K2 | K3 | K2 | K2 |
| Process C (Spray-Immersion) | | | | | | |
| Area according to DIN 53209 | m0/g0 | m0/g0 | m0/g0 | m0/g0 | m0/g0 | m0/g0 |
| Cut according to DIN 53167 in mm | 0.2 | 2.0 | 1.4 | 0.5 | 2.0 | 1.9 |
| Rockfall according to VW Standard | K2 | K2 | K1 | K3 | K2 | K2 |

In the determination of the degree of bubbles of paint coatings according to DIN 53 209 a bubble formation occuring in coatings is defined by indicating the degree of bubbles. The degree of bubbles, according to said Standard, is a measure for the bubble formation by rating the frequency of bubbles per unit area and the size of the bubbles. The degree of bubbles is denoted by a characteristic letter and a characteristic figure for the frequency of bubbles per unit area and by a characteristic letter and a characteristic figure for the size of the bubbles. The characteristic letter and characteristic figure m0 means the absence of bubbles, wheras m5 defines a certain frequency of bubbles per unit area in accordance with the bubble degree pictures according to DIN 53 209.

The size of the bubbles is provided with the characteristic letter and a characteristic figure within the range of from 0 to 5. The characteristic letter and characteristic figure q0 have the meaning of - no bubbles - whereas q5 is represented in accordance with bubble sizes corresponding to the bubble degree pictures according to DIN 53 209.

The degree of bubbles is detected by way of comparison of the coating, the degree of bubbles being that the picture of which is most similar to the appearance of the coating.

According to DIN 53 167 the salt sprayed mist test according to said Standard serves to determine the behavior of varnishes, paint coatings and other coatings upon the action of sprayed sodium chloride solution. If the coating exhibits weak points, pores or lesions, then permeation to underneath the coating (infiltration) will preferably start from these locations. This leads to a reduction in or loss of adhesion and corrosion of the metallic substrate.

The salt sprayed mist test is employed that such defects can be recognized and infiltration can be detected.

Infiltration (undercutting), within the meaning of said Standard, is the permeation of sodium chloride solution at the boundary area between coating and substrate or at the boundary area between individual coatings starting from a place of lesion produced (crevice) in a defined manner or from existing weak points (e.g. pores, edges). The width of the zone of reduces or lost adhesion serves as the measure for the resistance to sprayed sodium chloride solution of the coating on the respective substrate.

The VW Standard P-VW 1210 represents a change test consisting of a combination of various standardized testing procedures. Thus, in the present case, within the period of 60 days a test cycle is maintained which consists of 4 hours of salt spray test according to DIN 50 021,
4 hours of rest period at room temperature and
16 hours of condensation water constant conditions according to DIN 50 017.

In the beginning of the test, the test specimen is hit by a defined amount of steel shot of a definite particle size. After expiration of the testing period, a characteristic number is assigned to the degree of corrosion. In accordance with the characteristic numbers of from 1 to 10, the characteristic number 1 denotes a not visible corrosion, whereas at a characteristic number of 10 virtually the whole surface has been corroded.

One test cycle (7 days) of the VDA Changing Climate Test consists of 24 hours of salt spray test according to DIN 50 021,
96 hours of condensation water changing conditions according to DIN 50 017,
48 hours of rest period at room temperature.

In addition, in a manner analogous to that of the VW Changing Climate Test, a Rockfall Test according to the VW Standard was carried out.

What is claimed is:

1. A process for producing zinc phosphate coatings containing manganese and magnesium on metal surfaces selected from the group consisting of steel, zinc, aluminum, the alloys thereof, and combinations thereof by contacting the metal surfaces by a method selected from the group consisting of spraying, spray-immersion, immersion, and combinations thereof with an aqueous solution consisting essentially of the following components:

0.4 to 0.6 g/l of zinc(II) ions,
0.9 to 1.1 g/l of manganese(II) ions,
1.4 to 1.6 g/l of magnesium(II) ions,
12.0 to 16.0 g/l of phosphate ions,
1.0 to 5.0 g/l of nitrate ions,
0.4 to 0.6 g/l of fluoride ions, and, optionally, 0.2 to 0.8 g/l of nickel(II) ions, and, necessarily, an accelerator component selected from the group consisting of:

0.02 to 0.2 g/l of nitrite ions,
0.4 to 1 g/l of chlorate ions,
0.2 to 1.0 g/l of an organic oxidizing agent, and combinations of any two or of all of these, wherein the aqueous solution has a free acid content of 0.6 to 1.8 points and a total acid content of from 15 to 30 points and $Na^+$ ions are present in the amount necessary to adjust the free acid.

2. A process according to claim 1, wherein the aqueous solution contains from 0.25 to 0.5 g/l of nickel ions.

3. A process according to claim 2, wherein the aqueous solution comprises 3-nitrobenzene sulfonic acid or its sodium salt as an organic oxidizing agent.

4. A process according to claim 1, wherein the aqueous solution comprises 3-nitrobenzene sulfonic acid or its sodium salt as an organic oxidizing agent.

5. A process according to claim 4, performed at a temperature within the range from 40° to 70° C.

6. A process according to claim 5, wherein the metal surfaces are phosphated for a time in the range of from 1 to 5 minutes.

7. A process according to claim 6, comprising an additional step of painting the metal surfaces after they are phosphated.

8. A process according to claim 3, performed at a temperature within the range from 40° to 70° C.

9. A process according to claim 2, performed at a temperature within the range from 40° to 70° C.

10. A process according to claim 1, performed at a temperature within the range from 40° to 70° C.

11. A process according to claim 10, wherein the metal surfaces are phosphated for a time in the range of from 1 to 5 minutes.

12. A process according to claim 9, wherein the metal surfaces are phosphated for a time in the range of from 1 to 5 minutes.

13. A process according to claim 8, wherein the metal surfaces are phosphated for a time in the range of from 1 to 5 minutes.

14. A process according to claim 7, wherein the metal surfaces are phosphated for a time in the range of from 1 to 5 minutes.

15. A process according to claim 6, wherein the metal surfaces are phosphated for a time in the range of from 1 to 5 minutes.

16. A process according to claim 4, wherein the metal surfaces are phosphated for a time in the range of from 1 to 5 minutes.

17. A process according to claim 3, wherein the metal surfaces are phosphated for a time in the range of from 1 to 5 minutes.

18. A process according to claim 2, wherein the metal surfaces are phosphated for a time in the range of from 1 to 5 minutes.

19. A process according to claim 1, wherein the metal surfaces are phosphated for a time in the range of from 1 to 5 minutes.

20. A process according to claim 13, comprising an additional step of painting the metal surfaces after they are phosphated by an immersion electropainting process.

* * * * *